United States Patent [19]

Dunn

[11] Patent Number: 4,642,023

[45] Date of Patent: Feb. 10, 1987

[54] VENTED SHROUDED INDUCER

[75] Inventor: Charlton Dunn, Calabasas, Calif.

[73] Assignee: Rockwell International Corporation, El Segundo, Calif.

[21] Appl. No.: 759,983

[22] Filed: Jul. 29, 1985

[51] Int. Cl.[4] ..... F04D 29/66

[52] U.S. Cl. ..... 415/53 R; 415/143

[58] Field of Search ..... 415/53 R, 143, 115, 415/168, 169 R, 169 A, DIG. 1, 199.6; 416/181, 189, 191, 192

[56] References Cited

U.S. PATENT DOCUMENTS

| | | | |
|---|---|---|---|
| 2,685,429 | 8/1954 | Auyer | 415/DIG. 1 X |
| 4,003,671 | 1/1977 | Huse et al. | 416/189 |
| 4,357,914 | 11/1982 | Hauser | 415/DIG. 1 X |

FOREIGN PATENT DOCUMENTS

| | | | |
|---|---|---|---|
| 963540 | 7/1950 | France | 415/53 R |
| 225697 | 12/1968 | U.S.S.R. | 415/53 R |
| 591619 | 2/1978 | U.S.S.R. | 416/181 |

*Primary Examiner*—Robert E. Garrett
*Assistant Examiner*—Joseph M. Pitko
*Attorney, Agent, or Firm*—H. Fredrick Hamann; Harry B. Field; Clark E. DeLarvin

[57] ABSTRACT

A pump having a shrouded inducer rotatably mounted within a housing. An outer periphery of the shroud and an adjacent inner surface of the housing defines an annular space through which a recirculation flow of fluid occurs during operation of the pump. The shroud is provided with a plurality of vent holes located about an outer periphery of the shroud and extending therethrough to alleviate damage which would otherwise result from such recirculation flow.

5 Claims, 2 Drawing Figures

VENTED SHROUDED INDUCER

BACKGROUND OF THE INVENTION

1. Field of the Invention

The present invention relates to axial and centrifugal pumps and more particularly to such pumps which utilize shrouded inducers. The present invention provides a means for avoiding cavitation damage resulting from the recirculation of a fluid flow about an outer periphery of the shroud on such a pump.

2. Description of the Prior Art

It has been found that the addition of a shroud to an inducer eliminates the formation of vortices at or about the tips of the inducer blades and the corresponding cavitation damage to the inducer blade which would result from such vortices. The use of a shroud however, introduces new problems, namely, a portion of the fluid downstream of the inducer (high pressure discharge end) tends to recirculate about an outer periphery of the shroud and re-enter the main flow of fluid just upstream (low pressure, inlet end) of the inducer shroud and blades. As the recirculating, high-pressure fluid emerges from behind the shroud it creates vortices which impinge upon the more radially outward, inlet edges of the inducer blades. These vortices create an erosive action upon the afflicted portion of the blades and shroud which will result in a loss in efficiency and structural integrity as previously described with respect to an unshrouded blade tip. Thus, the provision of a shroud to avoid the problems associated with tip vortices is compromised by the problems associated with vortices shed at the forward or inlet edge of the shroud.

In attempts to overcome the problems associated with the shrouded inducer, it has been customary to provide labyrinth seals about the outer periphery of the inducer shroud to minimize the amount of fluid recirculated over the outer surface of the shroud. A labyrinth seal, however, only reduces the amount of flow it does not eliminate it. Further, labyrinth seals tend to lose their effectiveness with time due to wear; particularly in pumps where vibration and thermal transients subject the seal to any degree of rubbing. It has been proposed to make an extensive use of labyrinth seals for example, substantially throughout the length of the shroud (see U.S. Pat. No. 2,984,189). Obviously, however, such extensive use is impractical and costly.

U.S. Pat. No. 3,221,661 describes the centrifugal pump including a housing having an inlet section and a peripheral outlet section. An impeller is rotatably mounted in the housing and is provided with a shroud section. The shroud section is cylindrical adjacent to the inlet section and divergent adjacent to the peripheral outlet section. A terminal involute section is attached the interior of the shroud section and is located in the divergent portion of the shroud section. The patent further describes a means for introducing any fluid bypassing the shroud section into the pump housing adjacent the inlet section in a direction toward the impeller blades. A disadvantage of this device is that any fluid bypassing or recirculating about the outer periphery of the shroud is at an elevated pressure and is reintroduced into the pump in a region of low pressure, thus creating the potential problem of cavitation.

U.S. Pat. No. 4,449,888 describes a free-spool inducer pump. The pump comprises a housing, an impeller rotatable in the housing to discharge fluids centrifugally outwardly, a rotary spool having an inducer section through which intake fluid passes to the impeller and a rotary diffuser associated with the rotary spool. The diffuser has driving vanes located at the inlet of the diffuser and outwardly of the impeller periphery for rotatively driving the spool in response to outward flow of discharged fluid against and between the vanes. A disadvantage of this apparatus is its complexity and the associated cost of its manufacture.

Obviously, there still remains the need for a means of constructing a shrouded inducer which will substantially reduce, if not eliminate, the problems associated with vortices emanating from the shroud and which does not require costly and complex configurations.

3. Objects of the Invention

It is an object of the present invention to provide an improved shrouded inducer which will substantially minimize or eliminate any cavitation damage from fluid recirculating about an outer surface of the shroud.

It is another object of the present invention to provide a shrouded inducer which does not require an extensive number of labyrinth seals.

Yet another object of the present invention is to provide a shrouded inducer which suffers no cognizable degree of cavitation damage either from tip vortices or from vortices shed by fluid being recirculated about an outer periphery of the inducer shroud.

Still another object of the present invention is to provide a shrouded inducer which is readily fabricable without undue cost.

SUMMARY OF THE INVENTION

The foregoing and other objects are achieved by the present invention which provides a shrouded inducer which minimizes or substantially eliminates any damage causing vortices or cavitation resulting from fluid recirculating about an outer surface of the shroud. Broadly, the present invention provides an improvement in a shrouded inducer pump including a housing having a fluid inlet and fluid outlet interconnected by an axially extending cavity for receiving therein a rotatably mounted shrouded inducer. The shrouded inducer includes at least one spiral blade for causing movement of fluid from said inlet toward said outlet. The shroud of the shrouded inducer has an outer surface spaced apart from an inner surface of the cavity, the surfaces defining an annular space through which a recirculation flow of fluid could occur. The improvement provides a means for alleviating and minimizing the damage and loss of efficiency associated with such a recirculation flow. Specifically, the improvement comprises providing a plurality of vent holes or apertures at selected locations about the periphery of the shroud and extending therethrough such that the majority of any recirculation fluid flow will pass through the vent holes back into the shrouded inducer mixing with the main flow of fluid. The number, location and size of the holes are selected such that under normal operating conditions, the pressure of the recirculation fluid adjacent any given hole is in excess of the pressure of the fluid flowing through the shrouded inducer at that point. This pressure difference will ensure that any fluid flow that occurs is from the annular passageway into the inducer. The size, number and location of holes also is selected such that the pressure drop through the hole is less than that which would cause any vaporization of the fluid flowing therethrough or form any damage-causing vortices.

Other objects and novel features of the present invention will become apparent from the following detailed description of the invention when considered in conjunction with the accompanying drawings.

BRIEF DESCRIPTION OF THE DRAWINGS

Throughout the following description, the same elements or parts of the drawings are designated by the same reference characters, all equivalent or modified elements bear a prime designation.

DETAILED DESCRIPTION OF THE PREFERRED EMBODIMENTS

Figure 1:
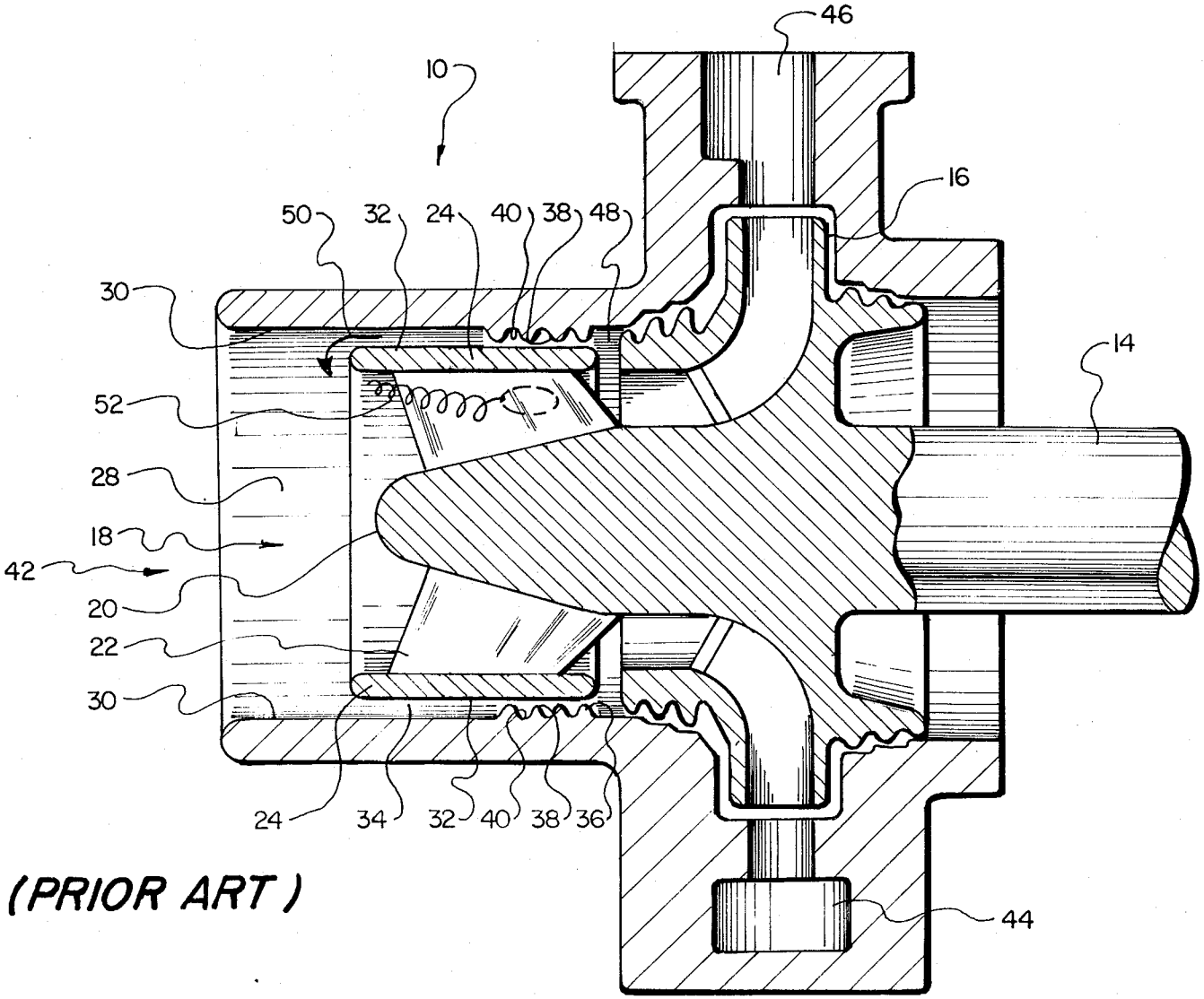
Fig. 1. (PRIOR ART)
FIG. 1 is a schematic, cross-sectional side view of a centrifugal pump having a shrouded inducer constructed according to the prior art.

Referring to FIG. 1 therein is depicted a typical prior art shrouded inducer pump assembly 10 which includes a housing 12. A drive shaft 14 extends into housing 12 and is rotatably supported by bearings (not shown). An impeller 16, located within housing 12, is affixed to drive shaft 14 for receiving rotational forces therefrom and imparting a rise in pressure to any fluid passing through housing 12. A shrouded inducer 18 is affixed to a terminal end 20 of drive shaft 14 for increasing the pressure of incoming fluid before it enters impeller 16. Alternatively, of course, shrouded inducer assembly 18 could be attached directly to impeller 16. Inducer assembly 18 comprises at least one and preferably a plurality of inducer blades 22 which extend radially outwardly and terminate in a substantially cylindrical shroud member 24.

As depicted, shrouded inducer assembly 18 is located within a cavity 28 defined by inner surfaces 30 of housing 12. In between inner surface 30 of housing 12 and an outer surface 32 of inducer assembly 18 there is formed an annular space 34 through which recirculation fluid could flow. To minimize any flow of recirculation fluid, it has been customary to provide a labyrinth seal 36 about the outer surface 32 of shroud 24 to minimize the flow of fluid through annular space 34. Typically labyrinth seal 36 will comprise a plurality of radially, inwardly extending peaks 38 having valleys 40 located there between.

In operation, torque is supplied through shaft 14 from an external power source (not shown) which typically would be an electric motor. A fluid is introduced through an inlet 42 of pump assembly 10. Shrouded inducer assembly 18 imparts a pressure rise to the incoming fluid and a swirl pattern favorable to the pumping operation of impeller 16. Impeller 16 further increases the pressure of the fluid and discharges it into an outlet volute from which it leaves pump 10 through an outlet 46. A portion of the fluid which passes through inducer assembly 18, especially that portion at or about a location designated 48 just downstream of shrouded inducer 18, being at a higher pressure than that fluid entering inlet 42 tends to enter annular space 34. Since this fluid is at a higher pressure than the incoming fluid at inlet 42 and as a result of the pumping action induced by motion of outer surface 32 of shroud 24 relative to the adjacent portion of pump housing 12, the fluid in annular space 34 tends to flow in the general direction indicated by the arrow designated 50. This flow, referred to herein as recirculation flow, will in the absence of the present invention cause cavitation damage to inducer blades 22. It will be appreciated that although arrow 50 indicates recirculation flow in an axial direction only that a substantial tangential component also will be present due to the rotational motion of the shroud.

Since the rotation of shroud 24 of the prior art imparts a substantial tangential component to the recirculating flow represented by the arrow designated 50, the recirculating flow tends to shed strong vortices 52 from the inlet end of prior art shroud 24. This tendency is further aggravated by the fact that the recirculation flow when it arrives at the inlet end of shroud 24 is flowing in an axial direction which opposes the main incoming flow. Since vortices 52 are strong and originate in close proximity of inducer blades 22, they impinge directly upon for example a region 54 of the blades. As a direct result, inducer blades 22 of the prior art may suffer severe cavitation damage at region 62 to the extent that the pump efficiency is affected and indeed even the structural integrity of blades 22 may often be compromised. Further, even when the shroud 24 is extended beyond the blades towards the inlet the problem is not overcome since the shroud itself may be damaged.

Figure 2:
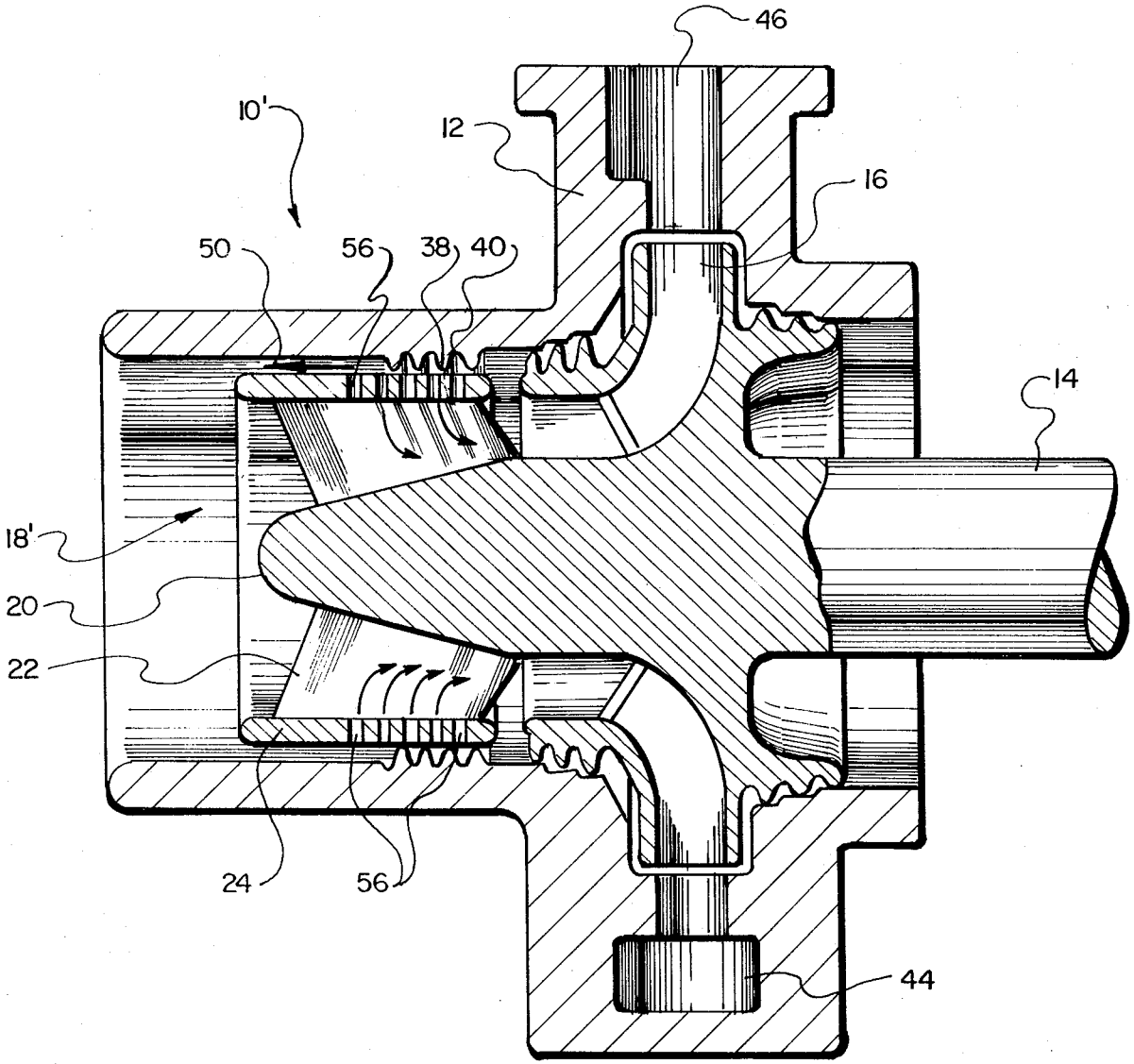
FIG. 2 is a schematic, cross-sectional side view of a centrifugal pump having a shrouded inducer constructed according to the preferred embodiment of the present invention.

Referring now to FIG. 2, a preferred embodiment of the present invention, the aforementioned problems of the prior art are avoided by the provision of a plurality of vent holes 56 which extend through shroud 24. Vent holes 56 which are located about the periphery of shroud 24 provide fluid communication between annular space 34 and the main stream of fluid flowing through inducer assembly 18. The size and number of vent holes 56 will vary depending upon a number of parameters such as the quantity of recirculation fluid anticipated during operation of the pump which will in turn be a function of the inlet and discharge pressures, clearances and the like. It is essential however that the size and number of holes be such that substantially all of the flow is from annular space 34 into the interior of inducer assembly 18. Thus there should not be so many holes or they should not have sufficient flow area that the pressure in annular space 34 is less than that existing within the interior of inducer assembly 18 at that particular location. Further, the size and number of holes 56 also should be sufficient such that only a minimal amount of flow travels past shroud 24 as indicated by arrow 50, i.e. substantially all of the recirculation fluid should pass through vent holes 56. In addition, the size of the individual holes and their location should be selected such that a pressure drop of the fluid passing therethrough is not so great as to cause any vaporization or cavitation. For any given shrouded inducer the calculations necessary to determine optimum hole size and number of such holes is readily within the skill of one versed in the art.

The location of the holes is not particularly critical though certain locations are preferred. For example, when a labyrinth seal is used, it is preferred that vent holes 56 be located opposite valleys 40 of seal 36.

In addition, vent holes 56 advantageously are located either substantially equidistant between blades 22 or in some instances it may be preferred to bias the location of the holes slightly in the direction of the inlet edge (lower pressure portion) of blade 22. In all instances, the holes will be located about the downstream periphery of shroud 24 since the fluid in annular space 34 adjacent the inlet will be substantially at the same pressure as the main stream of fluid flowing through pump assembly 10.

It will be apparent that many modifications and variations of the present invention are possible in light of the above teachings. It is to be understood, therefore, that within the scope of the appended claims the invention may be practiced otherwise than as specifically described.

What is claimed is:

1. In a pump having a shrouded inducer rotatably mounted within a housing wherein an outer periphery of the shroud and an adjacent inner surface of the housing defines an annular space which conveys a recirculation flow of fluid during operation of the pump, an improvement for alleviating damage associated with said recirculation flow, the improvement comprising;

a plurality of vent holes located about the outer periphery of the inducer shroud and extending therethrough for conveying said recirculation flow from said annular space back into said shrouded inducer.

2. The pump of claim 1 wherein said holes are located adjacent a high pressure end of said inducer.

3. The pump of claim 1 wherein said inducer is an axial flow inducer with an inlet end and an opposite end terminating adjacent an impeller.

4. The pump of claim 3 wherein said inducer has a plurality of blades and said holes are located substantially equidistant the blades.

5. The pump of claim 1 wherein said inducer has a plurality of blades and said holes are located substantially equidistant the blades.

* * * * *